United States Patent [19]

Hofer

[11] Patent Number: 4,660,717

[45] Date of Patent: Apr. 28, 1987

[54] TRAVELER CARRIER FOR REFILLING THE TRAVELER MAGAZINE OF A TRAVELER INSERTION DEVICE

[75] Inventor: Herbert Hofer, Monchen-Gladbach, Fed. Rep. of Germany

[73] Assignee: Reiners & Fürst, Monchen-Gladbach, Fed. Rep. of Germany

[21] Appl. No.: 694,421

[22] Filed: Jan. 24, 1985

[30] Foreign Application Priority Data

Jan. 25, 1984 [DE] Fed. Rep. of Germany ..... 3402402

[51] Int. Cl.[4] ..... B65D 73/02

[52] U.S. Cl. ..... 206/338; 206/340; 206/341; 206/346; 29/809; 24/543; 24/563

[58] Field of Search ..... 206/338, 328, 390, 340, 206/341, 346, 348; 24/236, 543, 563; 29/809

[56] References Cited

U.S. PATENT DOCUMENTS

| | | | |
|---|---|---|---|
| 354,235 | 12/1886 | Richards | 206/338 |
| 2,098,420 | 11/1937 | Jackson | 206/338 |
| 2,939,147 | 6/1960 | Jacobson | 206/338 |
| 3,231,076 | 1/1966 | Freiman | 206/586 |
| 3,294,229 | 12/1966 | McConnell et al. | 24/563 |
| 3,793,696 | 2/1974 | Barr et al. | 29/809 |
| 4,125,188 | 11/1978 | Greiner | 206/338 |
| 4,326,661 | 4/1982 | Maurer et al. | 206/338 |
| 4,353,481 | 10/1982 | Tando | 206/328 |
| 4,463,851 | 8/1984 | Cecil | 206/328 |
| 4,508,220 | 4/1985 | Pearson | 206/390 |

FOREIGN PATENT DOCUMENTS

| | | | |
|---|---|---|---|
| 1533316 | 6/1968 | France | 206/328 |

*Primary Examiner*—William Price
*Assistant Examiner*—Brenda J. Ehrhardt
*Attorney, Agent, or Firm*—Herbert L. Lerner; Laurence A. Greenberg

[57] ABSTRACT

A traveler carrier for refilling a traveler magazine of a traveler insertion device with travelers, includes a clip formed of springy flexible material holding the travelers together in a row by spring action from outside the travelers, the clip having an open longitudinal slot formed therein.

4 Claims, 3 Drawing Figures

TRAVELER CARRIER FOR REFILLING THE TRAVELER MAGAZINE OF A TRAVELER INSERTION DEVICE

The invention relates to a traveler carrier for refilling the traveler magazine of a traveler insertion device.

Insertion devices for inserting travelers into the rings of spinning machines or twisting frames (twiners) are made in various forms. As a rule they are hand-held devices. The traveler magazine of these devices is formed of a rail on which the travelers are aligned.

Traveler magazines are used for inserting the travelers because it is too cumbersome to insert each traveler individually. The traveler carrier holds a group of densely stacked travelers together to form a rod, so that they can be transferred to the traveler magazine of a traveler insertion device in the form of packages.

Heretofore it was conventional to make such traveler carriers in the form of shrink sleeves. A shrink sleeve completely surrounds the stacked row of travelers and has to be cut open along its full length in order to transfer the travelers to the traveler magazine, an operation which frequently results in damage to the travelers.

It is also conventional to enclose the row of stacked travelers in a fast-drying chemical substance. However, in this case the division into separate traveler packages and the removal of the chemical substance is even more complicated, requires more time, and may also lead to damage to the travelers.

Finally, it is also known to insert or feed the stacked travelers into a tube-like device, or to mount them on a rod. However, in this case the outer surface of the travelers is unprotected and is exposed to different kinds of damage, corrosion and contamination. In this case it is therefore absolutely necessary to provide special provisions in advance against damage and dirt, which is also complicated and costly, and creates problems during the subsequent transfer into the traveler magazine, at which time the removal of the outer protective wrapping again entails the danger of damage to the travelers.

The traveler carriers presently used are not suited very well especially for small, very light and thin travelers which, for instance, are only a few millimeters in length, measured diagonally.

It is accordingly an object of the invention to provide a traveler carrier for refilling the traveler magazine of a traveler insertion device, which overcomes the hereinafore-mentioned disadvantages of the heretofore-known devices of this general type, in which there is no danger of damage to the travelers during storage, handling and transfer into the traveler magazine of a traveler insertion device, even with very small travelers.

With the foregoing and other objects in view there is provided, in accordance with the invention, a traveler carrier for refilling a traveler magazine of a traveler insertion device with travelers, the traveler carrier comprising a clip formed of springy flexible material holding the travelers stacked together in a row by spring action from outside the travelers, the clip having an open longitudinal slot formed therein.

A clip of this configuration, together with the travelers disposed in a row therein, is simply slid onto the rail-like traveler magazine of the traveler insertion device, and thereafter the clip is pulled off to the side, without requiring a special tool in order to perform this operation.

In accordance with another feature of the invention, the clip has an inner surface matching or adapted to the shape of the travelers and surrounding the majority or larger part of the surface of the row of travelers. This is done in order to better protect the outside of the travelers from damage due to the environment.

In accordance with a further feature of the invention, the longitudinal slot is at least wide enough to expose tips of the traveler. This has various advantages. First, the clip can be more easily removed after the travelers have been transferred into the traveler magazine of the traveler insertion device. Second, the receiving element of the traveler magazine can also be provided with a rail, which has parts that project between the tips of the travelers. Third, the advantage of the outer protection of the travelers is still maintained.

In accordance with a concomitant feature of the invention, part of the clip contacts the travelers, and at least the part of the clip is formed of synthetic material. It is advantageous if the whole clip is formed of a springy, elastically yielding or flexible plastic. In this case, damage to the travelers is completely eliminated. Plastic clips are very flexible, and also adapt themselves to traveler magazines with curved receiving rails. Plastic clips can also be more easily removed after the travelers have been inserted and the clip is pulled off to the side.

Other features which are considered as characteristic for the invention are set forth in the appended claims.

Although the invention is illustrated and described herein as embodied in a traveler carrier for refilling the traveler magazine of a traveler insertion device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
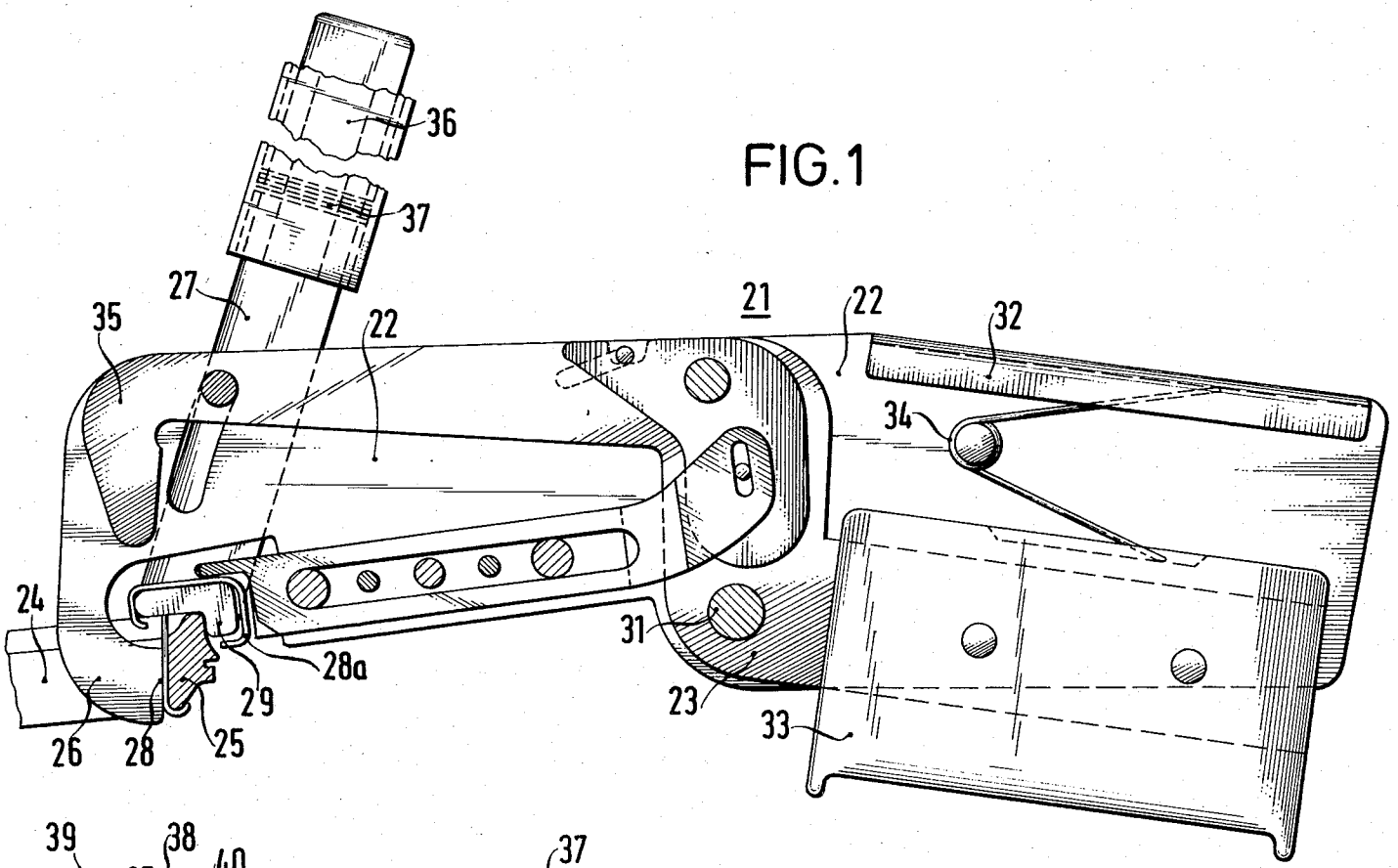
FIG. 1 is a fragmentary, diagrammatic, partially cross-sectional side-elevational view of a hand operated traveler insertion device with a mounted traveler carrier.
Figure 2:
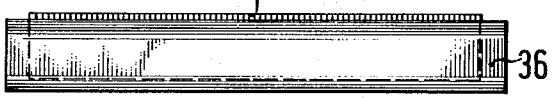
FIG. 2 is a side-elevational view of a traveler carrier with inserted clips.

Referring now to the figures of the drawings as a whole, there is seen a plier-type traveler insertion device 21 which has two plier legs 22, 23. The plier leg 22 is provided with a hook-shaped nose 26 for supporting the traveler insertion device at the inner surface 24 of a ring 25. A traveler magazine 27 which is formed of a rail onto which adjacent travelers are to be mounted ends at the nose 26. The traveler magazine 27 extends downward in the shape of an arc. FIG. 1 shows the lower end 29 of the traveler magazine 27 in profile. As seen in FIG. 1, a traveler 28 is already positioned on the ring 25 while another traveler **28*a* is still located on the traveler magazine 27**.

The plier-type legs 22, 23 are connected with each other by a bolt 31, so that they articulate like pliers. A hand grip 32 is provided at the right end of the leg 22, and a hand grip 33 is provided at the right end of the leg 23. The legs of the pliers are spread apart at the grips by a spiral or helical-torsion spring 34. In order to operate the traveler insertion device 21, the two grips are pressed together against the action of the spring 34.

The second leg 23 ends in a hook-shaped bent lever 35, which acts mechanically on a single traveler 28*a* from the top, and transports it onto the ring 25 as the device is operated. This operation is described, illustrated and explained in detail in German Published, Non-Prosecuted Application DE-OS No. 29 27 618, for example.

Figure 3:
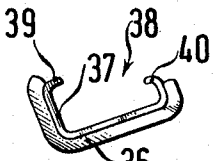
FIG. 3 is a front-elevational view of the traveler carrier shown in FIG. 2.

According to the invention, a traveler carrier 36 is mounted onto the traveler magazine 27 for replenishing the traveler magazine. The traveler carrier 36 is constructed in the form of a clip made of springy and flexible synthetic material. The clip holds together travelers 37 which are densely aligned with each other by spring action from the outside. According to FIG. 3, the inner surface of the clip 36 is fitted to the shape of the travelers 37 in such a way that the stacked travelers are surrounded by the clip over a large area. The open longitudinal slot 38 is at least wide enough so that the tips 39, 40 of the travelers 37 are free.

The invention should not be limited to the illustrated and described embodiment which is used as an example. The same applies for the outer shape of the clips. In the embodiment used as an example, the travelers are ear-shaped and the clip is adapted to their shape. However, there are other forms of travelers, such as C-shaped travelers, which are provided with suitably adapted clips depending on size and shape. The clips can be re-used, and are not tied to specific traveler insertion devices.

Another advantage of the invention is the feature that after ending the loading operation, remaining travelers which are still on the rail in the traveler magazine can be placed into the clip again and thus be reclaimed. Heretofore, left-over travelers had to be discarded.

Conversely, opened clips, i.e. clips which still contain travelers after filling the magazine, can be saved and used again.

The foregoing is a description corresponding in substance to German Application No. P 34 02 402.6, filed Jan. 25, 1984, the International priority of which is being claimed for the instant application, and which is hereby made part of this application. Any material discrepancies between the foregoing specification and the aforementioned corresponding German application are to be resolved in favor of the latter.

I claim:

1. Traveler carrier for refilling a traveler magazine of a traveler insertion device with travelers disposed in a row defining a lateral surface of the row, the traveler carrier comprising a clip formed of springy flexible material having an open longitudinal slot formed therein having a given length and being large enough to allow lateral insertion and removal of the entire row of travelers through said slot throughout said given length of said slot, said clip including means for gripping said row of travelers by pressing against the lateral surface thereof and for holding the travelers together in the row by spring action from outside the travelers.

2. Traveler carrier according to claim 1, wherein said clip has an inner surface matching the shape of the travelers and surrounding the majority of the surface of the row of travelers.

3. Traveler carrier according to claim 1, wherein said longitudinal slot is at least wide enough to expose tips of the travelers.

4. Traveler carrier according to claim 1, wherein part of said clip contacts the travelers, and at least said part of said clip is formed of synthetic material.

* * * * *